US010875311B2

(12) United States Patent
Maeno

(10) Patent No.: US 10,875,311 B2
(45) Date of Patent: Dec. 29, 2020

(54) INK-JET PRINTER FOR SUPPRESSING INK REMAINING

(71) Applicant: MIMAKI ENGINEERING CO., LTD., Nagano (JP)

(72) Inventor: Shoko Maeno, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/379,804

(22) Filed: Apr. 10, 2019

(65) Prior Publication Data

US 2019/0315127 A1 Oct. 17, 2019

(30) Foreign Application Priority Data

Apr. 11, 2018 (JP) ..... 2018-076086

(51) Int. Cl.
*B41J 2/165* (2006.01)

(52) U.S. Cl.
CPC ..... *B41J 2/16538* (2013.01); *B41J 2/165* (2013.01); *B41J 2/16517* (2013.01)

(58) Field of Classification Search
CPC ..... B41J 2/16538; B41J 2/165; B41J 2/16517
See application file for complete search history.

(56) References Cited

U.S. PATENT DOCUMENTS

2002/0134305 A1 9/2002 Miki et al.
2007/0046724 A1* 3/2007 Jung ..... B41J 2/16535 347/33
2013/0208047 A1 8/2013 Yoshiike
2014/0028757 A1 1/2014 Kurosu et al.
2015/0273836 A1* 10/2015 Akuta ..... B41J 2/16541 347/33

FOREIGN PATENT DOCUMENTS

JP 04235054 A * 8/1992 ..... B41J 2/1433
JP H07195686 8/1995
JP 2012166374 9/2012
WO 2014129010 8/2014

OTHER PUBLICATIONS

"Search Report of Europe Counterpart Application," dated Aug. 6, 2019, pp. 1-9.

* cited by examiner

*Primary Examiner* — Sharon Polk
(74) *Attorney, Agent, or Firm* — JCIPRNET

(57) ABSTRACT

An ink-jet printer includes; an ink-jet head having a nozzle surface in which a plurality of nozzles for discharging ink; and a wiping device, having a blade for wiping the nozzle surface, which wipes the nozzle surface by use of the blade, by moving the blade in relation to the nozzle surface; wherein, the ink-jet head includes a convex wall part that surrounds the nozzle surface in a state of protruding in a direction in which the ink is discharged by the nozzles; and a direction of wiping by the wiping device is almost the same as a stretching direction of a line connecting the nozzles being closest to the convex wall part, among the plurality of nozzles formed in the nozzle surface, and a part of the convex wall part being closest to the nozzles. Hence, reducing an incidence of defective discharging of ink by the ink-jet head.

5 Claims, 8 Drawing Sheets

INK-JET PRINTER FOR SUPPRESSING INK REMAINING

CROSS-REFERENCE TO RELATED APPLICATION

This application claims the priority of Japanese Patent Application No. 2018-076086, filed on Apr. 11, 2018. The entirety of the above-mentioned patent application is hereby incorporated by reference herein and made a part of this specification.

BACKGROUND OF THE INVENTION

The present disclosure relates to an ink-jet printer that carries out printing operation by way of discharging ink onto a medium.

Known as a conventional ink-jet printer is a printer that includes; an ink-jet head provided with a nozzle surface, in which a plurality of nozzles for discharging ink are formed; and a wiping device which is provided with a blade for wiping the nozzle surface, in order to perform wiping operation for the nozzle surface by use of the blade, by way of moving the blade in relation to the nozzle surface (for example, refer to Patent Document 1).

[Patent Document 1] Japanese Unexamined Patent Application Publication No. 2012-166374

Unfortunately, in the case of a conventional ink-jet printer; just after a nozzle surface is wiped by a blade, sometimes ink still remains on the nozzle surface, so that there exists a problem that the ink remaining on the nozzle surface after wiping operation causes an ink-jet head to discharge ink defectively.

Then, it is an objective of the present disclosure to provide an ink-jet printer with which it is possible to reduce an incidence of defective discharging of ink by an ink-jet head.

SUMMARY OF THE INVENTION

An ink-jet printer according to the present disclosure comprises an ink-jet head provided with a nozzle surface in which a plurality of nozzles for discharging ink are formed; and a wiping device, provided with a blade for wiping the nozzle surface, which carries out wiping the nozzle surface by use of the blade, by way of moving the blade in relation to the nozzle surface; wherein, the ink-jet head is provided with a convex wall part that surrounds the nozzle surface in a state of protruding in a direction in which the ink is discharged by the nozzles; and a direction of wiping by the wiping device is almost the same as a stretching direction of a line connecting specific nozzles being closest to the convex wall part, among the plurality of nozzles formed in the nozzle surface, and a part of the convex wall part being closest to the specific nozzles.

As a result of the study, it was found that i.e., "the ink is liable to remain and an amount of the remaining ink is much more after wiping the nozzle surface by a blade, at a vicinity of an end of the convex wall part within the nozzle surface in a direction perpendicular to a wiping direction, in comparison to a vicinity of an end of the convex wall part within the nozzle surface in the wiping direction."

Incidentally, a risk of an incidence of defective discharging of the ink by the ink-jet head is heightened, owing to presence of the ink, remaining on the nozzle surface after wiping, in the vicinity of the nozzles. It is because the ink remaining in the vicinity of the nozzles moves onto the nozzles so as to become a cause of defect, such as plugging the nozzles, and the like. Therefore, it is preferable that the nozzles are not located in the vicinity of an area where the ink is liable to remain after wiping the nozzle surface by use of the blade.

In the case of the ink-jet printer according to the present disclosure, wiping operation is carried out in a direction being almost the same as a stretching direction of the line connecting the specific nozzles being closest to the convex wall part, among the plurality of nozzles formed in the nozzle surface, and a part of the convex wall part being closest to the above-mentioned nozzles; in such a way that, being compared to a case of configuration in which wiping operation is carried out in a direction perpendicular to the above-described direction, the ink is unlikely to remain in the vicinity of the end of the convex wall part so that the remaining amount of the ink is less.

Accordingly, the ink-jet printer according to the present disclosure is able to suppress presence of the ink remaining on the nozzle surface after wiping operation, in the vicinity of the nozzles; and as a result, an incidence of defective discharging of the ink by the ink-jet head can be reduced.

In the ink-jet printer according to the present disclosure, the nozzle surface may have a liquid-repellent property.

In the case where the nozzle surface having a liquid-repellent property is wiped by a blade, the ink existing on the nozzle surface is removed by the blade in a state of being repelled by way of the liquid-repellent property of the nozzle surface so as to be collected. In the meantime, a hole of the nozzles of the nozzle surface is inevitably filled with the ink, while the hole does not have a liquid-repellent property, so that the ink is liable to remain after wiping operation by a blade, around the hole of the nozzles and its vicinity, in comparison to any area other than the vicinity of the hole of the nozzles.

In the case where a distance from the hole of the nozzles to the convex wall part is short; if the amount of the ink remaining in the vicinity of the end of the convex wall part is substantially large after wiping the nozzle surface by use of the blade, a risk of the ink to become a cause of defect, by way of moving onto the nozzles and plugging the nozzles, and the like, is heightened; wherein the ink remains in the vicinity of the end of the convex wall part.

According to the present embodiment, the nozzle surface is wiped by the blade in the direction being almost the same as the stretching direction of the line connecting the nozzles being closest to the convex wall part, among the plurality of nozzles formed in the nozzle surface, and a part of the convex wall part being closest to the above-mentioned nozzles; in such a way that, being compared to the case where the nozzle surface is wiped by the blade in the direction, perpendicular to the above-described direction, the ink is unlikely to remain in the vicinity of the nozzles in the neighborhood of the convex wall part in the nozzle surface, and therefore, the amount of the ink remaining can be made less.

Accordingly, even in the case where a distance from the nozzles to the convex wall part is short, and the nozzle surface has a liquid-repellent property, the amount of the ink remaining can be made less in the vicinity of the end of the convex wall part after wiping the nozzle surface by use of the blade, so that it is possible to suppress a defective incidence, such as the ink moving onto the nozzles and plugging the nozzles, and the like; wherein the ink remains in the vicinity of the end of the convex wall part.

In the ink-jet printer according to the present disclosure, the blade may have flexibility; and a length of the blade in a direction perpendicular to the direction of wiping may be a length that makes it possible to simultaneously contact tip parts, protruding in the direction in which the ink is discharged, of two facing parts of the convex wall part, at a time of wiping operation by the wiping device; the facing parts facing each other in the direction perpendicular to the direction of wiping; and the wiping device may wipe out the nozzle surface by use of the blade, while making the blade simultaneously contact the tip parts of the two facing parts.

After an end of the blade, being in a direction perpendicular to the wiping direction, slides on the nozzle surface, sometimes the ink remains in a form according to a trajectory of the end of the blade, at a position of the nozzle surface where the blade does not slide. Fortunately, in the case of the ink-jet printer according to the present disclosure; at a time when the nozzle surface is wiped by the blade, the blade simultaneously contacts the tip parts of the two facing parts of the convex wall part; and therefore, the end of the blade, being in the direction perpendicular to the wiping direction, does not slide on the nozzle surface. Accordingly, the ink-jet printer according to the present disclosure can reduce the amount of the ink remaining on the nozzle surface having been wiped; and as a result, an incidence of defective discharging of the ink by the ink-jet head can be reduced.

In the ink-jet printer according to the present disclosure, the wiping device may keep the blade from contacting a specific range adjacent to the facing parts in the nozzle surface, at the time of wiping the nozzle surface by use of the blade.

According to this configuration; at the time of wiping the nozzle surface by use of the blade, the ink-jet printer according to the present disclosure does not have the blade contact an area of the specific range in the vicinity of the facing parts in the nozzle surface; and therefore, being compared to a case of configuration in which the blade contacts the area of the specific range in the vicinity of the facing parts in the nozzle surface at the time of wiping the nozzle surface by use of the blade, a blade having low flexibility can be employed; and as a result, durability of the blade can be improved.

In the ink-jet printer according to the present disclosure, the nozzles may not be formed in the specific range.

In an area of the nozzle surface where the nozzles are formed, the ink is liable to remain just after wiping the nozzle surface by the blade. Fortunately, in the case of the ink-jet printer according to the present disclosure; the nozzles are not formed in the area of the range, which the blade does not contact at the time of wiping, in the nozzle surface; and therefore, the amount of the ink remaining in the vicinity of the nozzles in the neighborhood of the convex wall part, in the nozzle surface having been wiped, can be reduced; and as a result, an incidence of defective discharging of the ink by the ink-jet head can be reduced.

The ink-jet printer according to the present disclosure is able to reduce an incidence of defective discharging of ink by the ink-jet head.

DESCRIPTION OF THE PREFERRED EMBODIMENT

A preferred embodiment according to the present disclosure is explained below with reference to the drawings.

At first, a configuration of an ink-jet printer according to the present embodiment is explained.

Figure 1:
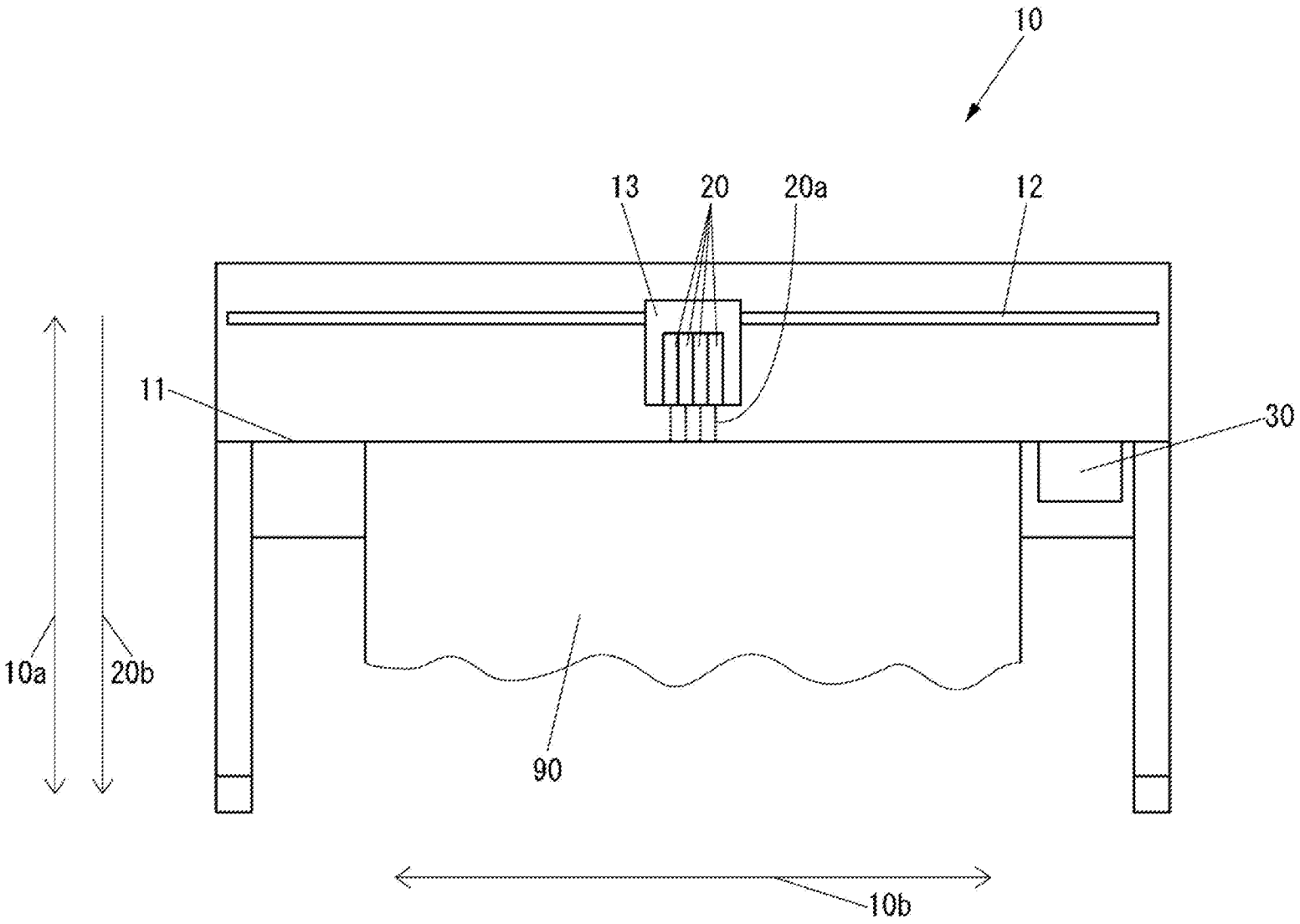
FIG. 1 is a schematic front elevation view of an ink-jet printer according to an embodiment of the present disclosure.

FIG. 1 is a schematic front elevation view of an ink-jet printer 10 according to the present embodiment.

As shown in FIG. 1, the ink-jet printer 10 includes; a platen 11 that supports a medium 90 from a downside in a vertical direction represented with an arrow 10*a*; a rail 12 stretching in a horizontal direction represented with an arrow 10*b*, which is perpendicular to the direction represented with the arrow 10*a*; a carriage 13 that is supported by the rail 12 so as to be movable in the direction represented with the arrow 10*b*; and an ink-jet head 20, installed in the carriage 13, which discharges ink 20*a* toward the medium 90. The ink-jet printer 10 is provided with, for example, four ink-jet heads 20 that are individually able to discharge the ink 20*a* of yellow, magenta, cyan, and black. As the ink 20*a*, there can be used various kinds of ink. The ink 20*a* can be, for example, water-base ink, solvent ink, or ultraviolet (UV) ink as well.

Figure 2A:
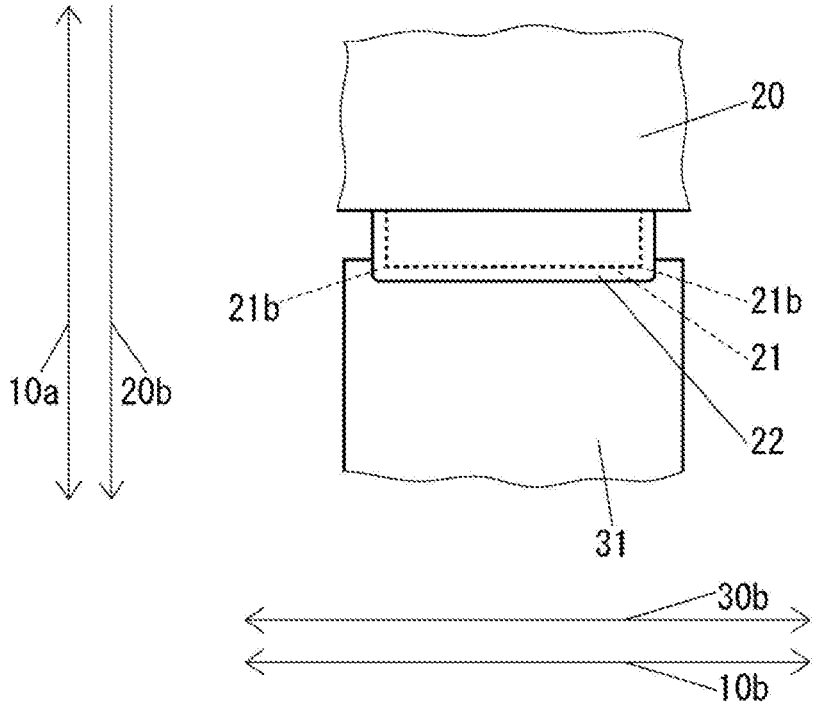
FIG. 2A is a front elevation view of a neighborhood part of a nozzle surface of an ink-jet head in a state of being installed in the ink-jet printer shown in FIG. 1.
Figure 2B:
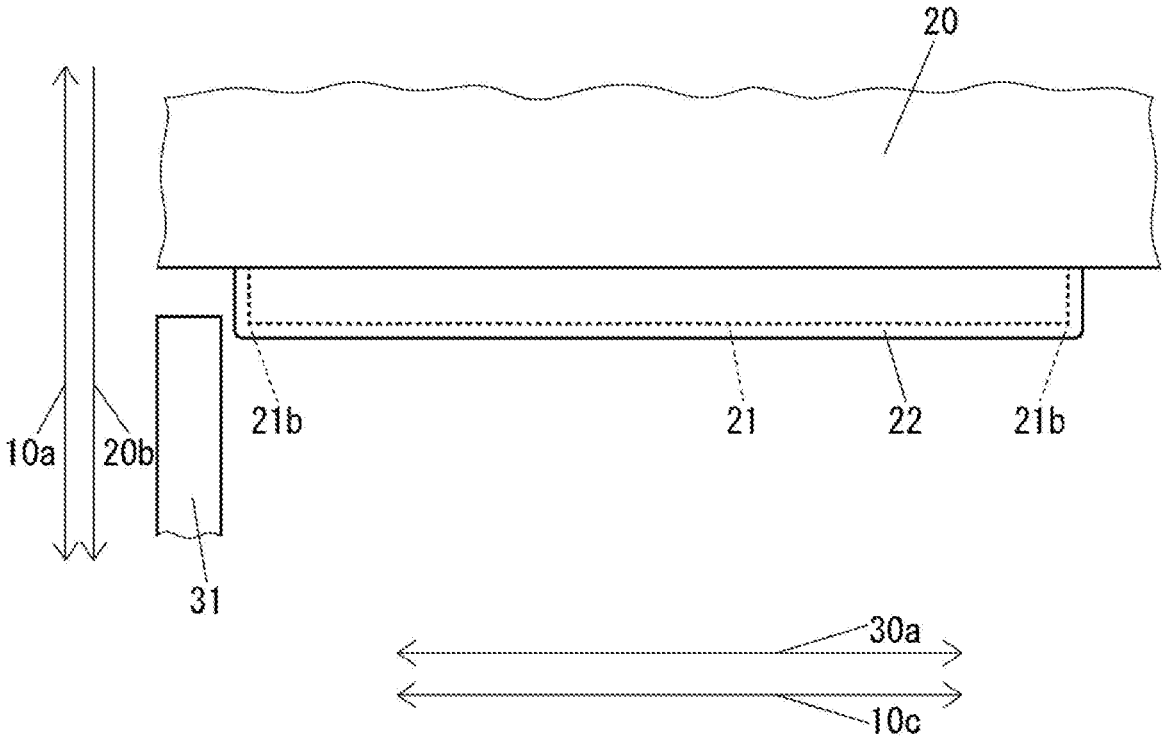
FIG. 2B is a side elevation view of the neighborhood part of the nozzle surface of the ink-jet head in a state shown in FIG. 2A.
Figure 3:
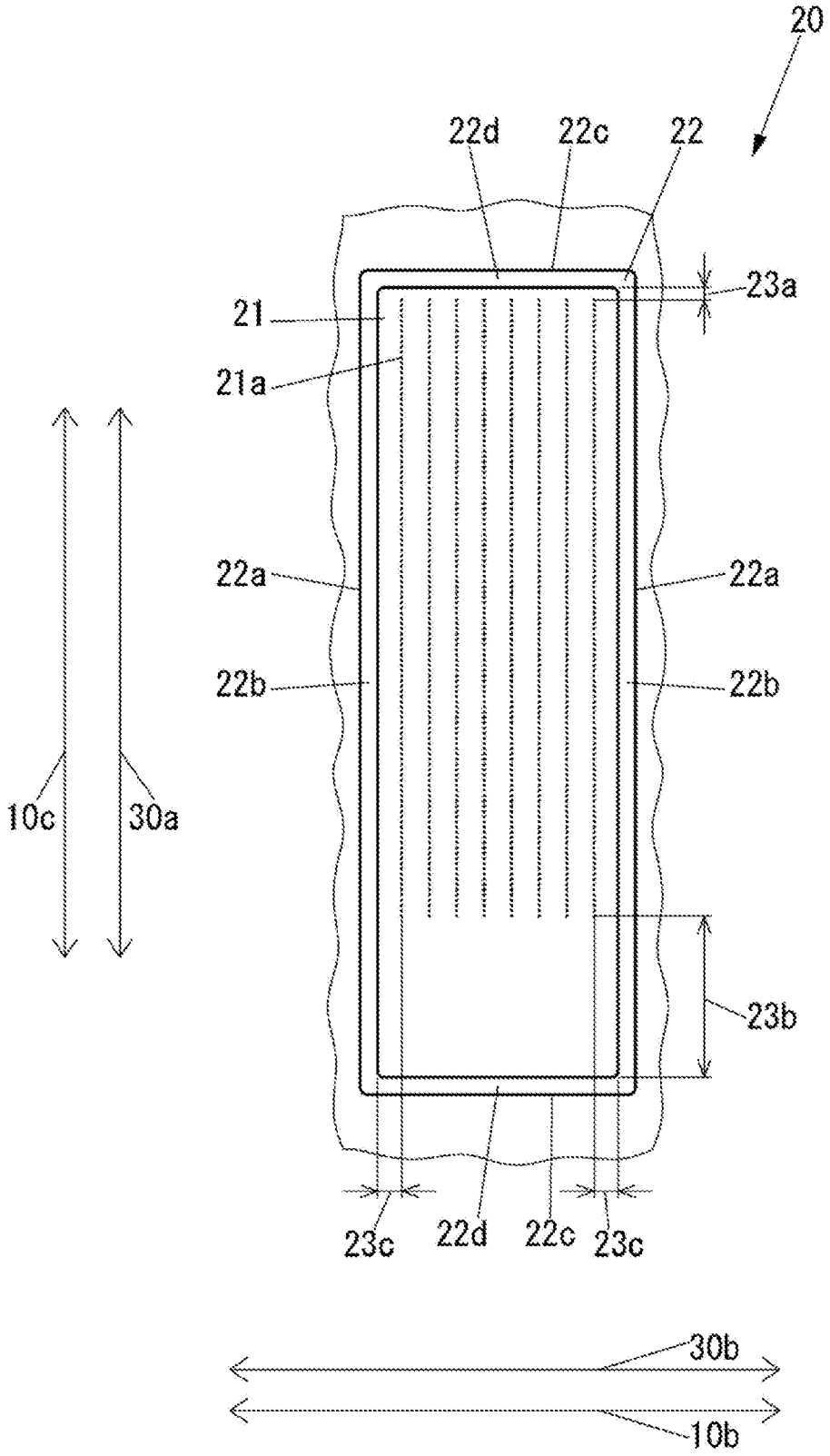
FIG. 3 is a bottom plan view of a part of the ink-jet head in a state of being installed in the ink-jet printer shown in FIG. 1.
Figure 4:
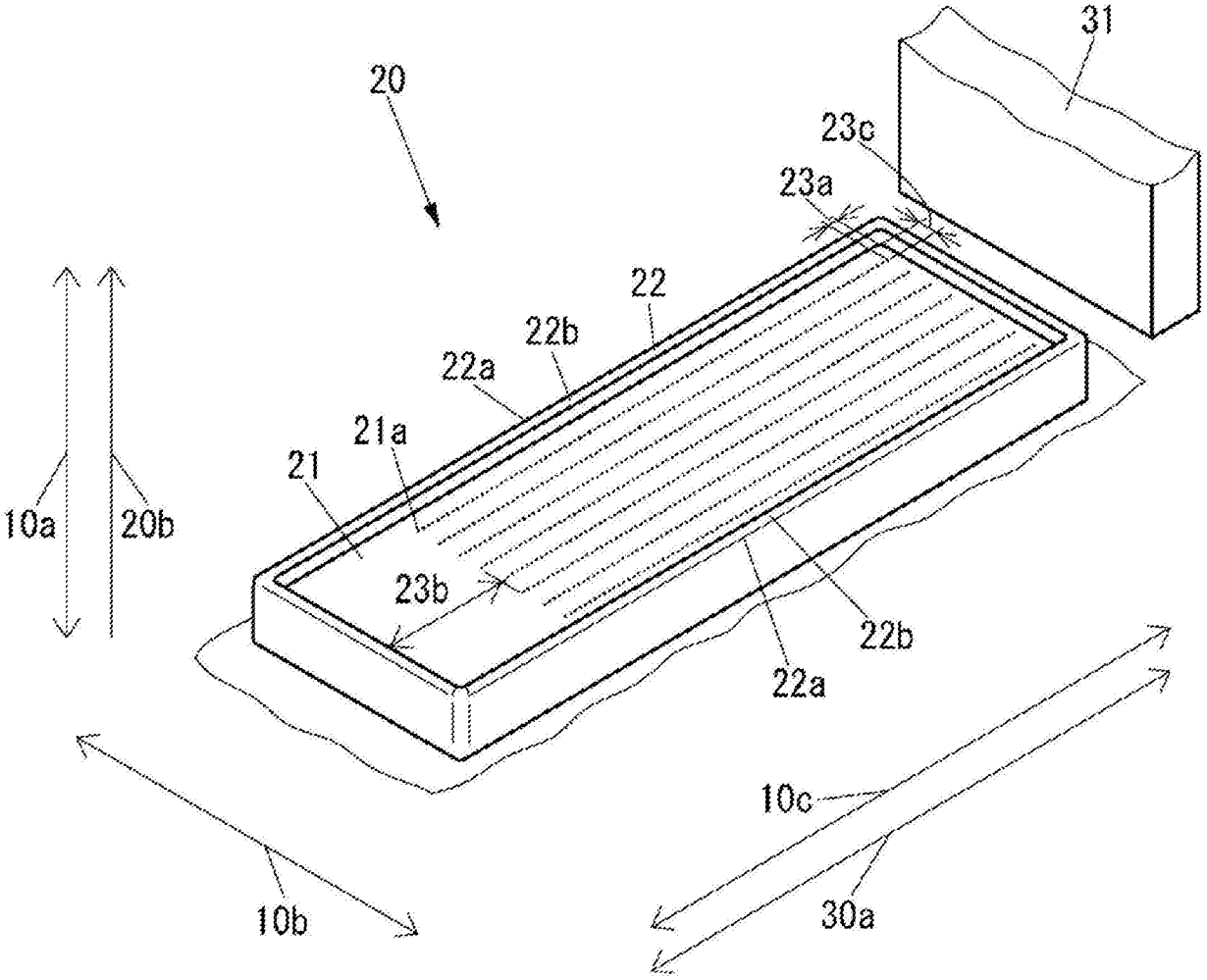
FIG. 4 is an external perspective view of a part of the ink-jet head in a state of being installed in the ink-jet printer shown in FIG. 1, wherein the external perspective view being observed from a bottom side.

FIG. 2A is a front elevation view of a neighborhood part of a nozzle surface 21 of the ink-jet head 20 in a state of being installed in the ink-jet printer 10. FIG. 2B is a side elevation view of the neighborhood part of the nozzle surface 21 of the ink-jet head 20 in a state shown in FIG. 2A. FIG. 3 is a bottom plan view of a part of the ink-jet head 20 in a state of being installed in the ink-jet printer 10. FIG. 4 is an external perspective view of a part of the ink-jet head 20 in a state of being installed in the ink-jet printer 10, wherein the external perspective view being observed from a bottom side.

In FIG. 2A, FIG. 2B, and FIG. 4, there is illustrated a blade 31 for wiping the nozzle surface 21, for reference. The blade 31 is not a constituent element of the ink-jet head 20. FIG. 2A, FIG. 2B, and FIG. 4 shows just an example, with respect to the number of rows of nozzles 21*a* as well as the number of the nozzles 21*a* in a row As show in FIG. 2A through FIG. 4, the ink-jet head 20 includes the nozzle surface 21 in which a plurality of nozzles 21*a* to discharge the ink 20*a* (refer to FIG. 1) are formed, and a convex wall part 22 that surrounds the nozzle surface 21 in a state of protruding in a direction, represented with an arrow 20*b*, in which the ink 20*a* is discharged by the nozzles 21*a*.

The nozzle surface 21 is coated with a material having a liquid-repellent property; in other words, a strong property of repelling the ink 20*a*; so as to have a strong liquid-repellent property. Meanwhile, in the nozzle surface 21, a location of the nozzles 21*a* does not have a liquid-repellent property; and accordingly, the ink 20*a* is more likely to stay in a vicinity of the nozzles 21*a*, in comparison to any other area excluding the vicinity of the nozzles 21*a*. A distance 23*a* between the nozzles 21*a* at one end in a direction represented with an arrow 10*c* and the convex wall part 22, wherein the direction represented with the arrow 10*c* being perpendicular to both the direction represented with the arrow 10*a* and the direction represented with the arrow 10*b*, is shorter than a distance 23*b* between the nozzles 21 at the other end in the direction represented with the arrow 10*c* and the convex wall part 22. A distance 23*c* between the nozzles 21*a* at an end in the direction represented with the arrow 10*b* and the convex wall part 22 is longer than the distance 23*a*, and shorter than the distance 23*b*.

In the case where the convex wall part 22 does not exist, the blade 31 is scraped off by a corner 21*b* every time when the blade 31 contacts the corner 21*b* of an edge of the nozzle surface 21 at a time of wiping, to be described later. A provision of the convex wall part 22 is for a purpose of suppressing abrasion of the blade 31, by way of preventing the blade 31 from contacting the corner 21*b* of the edge of the nozzle surface 21 at a time of wiping.

As shown in FIG. 1, the ink-jet printer 10 is provided with a wiping device 30 for wiping the nozzle surface 21 by use of the blade 31, by way of moving the blade 31 (refer to FIG. 2A and FIG. 2B) in relation to the nozzle surface 21 (refer to FIG. 2A and FIG. 2B); wherein the wiping device 30 being located at a vicinity of an end of a traveling range of the ink-jet head 20 in the direction represented with the arrow 10*b*.

The wiping device 30 includes the blade 31 having flexibility, and a blade driving device, which is not illustrated, for moving the blade 31 in relation to the nozzle surface 21.

Figure 5A:
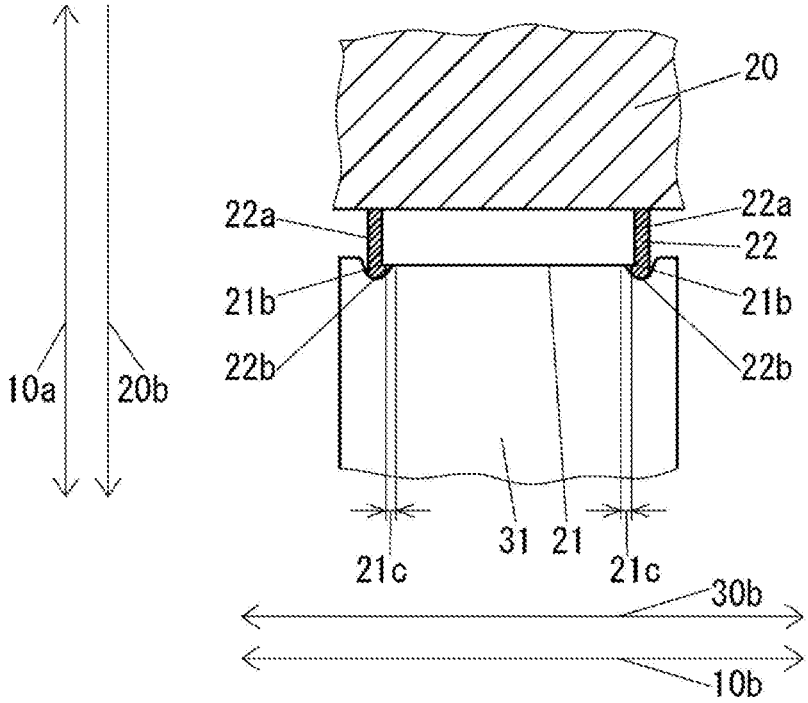
FIG. 5A is a front sectional view of the neighborhood part of the nozzle surface of the ink-jet head shown in FIG. 2A and FIG. 2B, in a state of the nozzle surface being wiped by a wiping device.
Figure 5B:
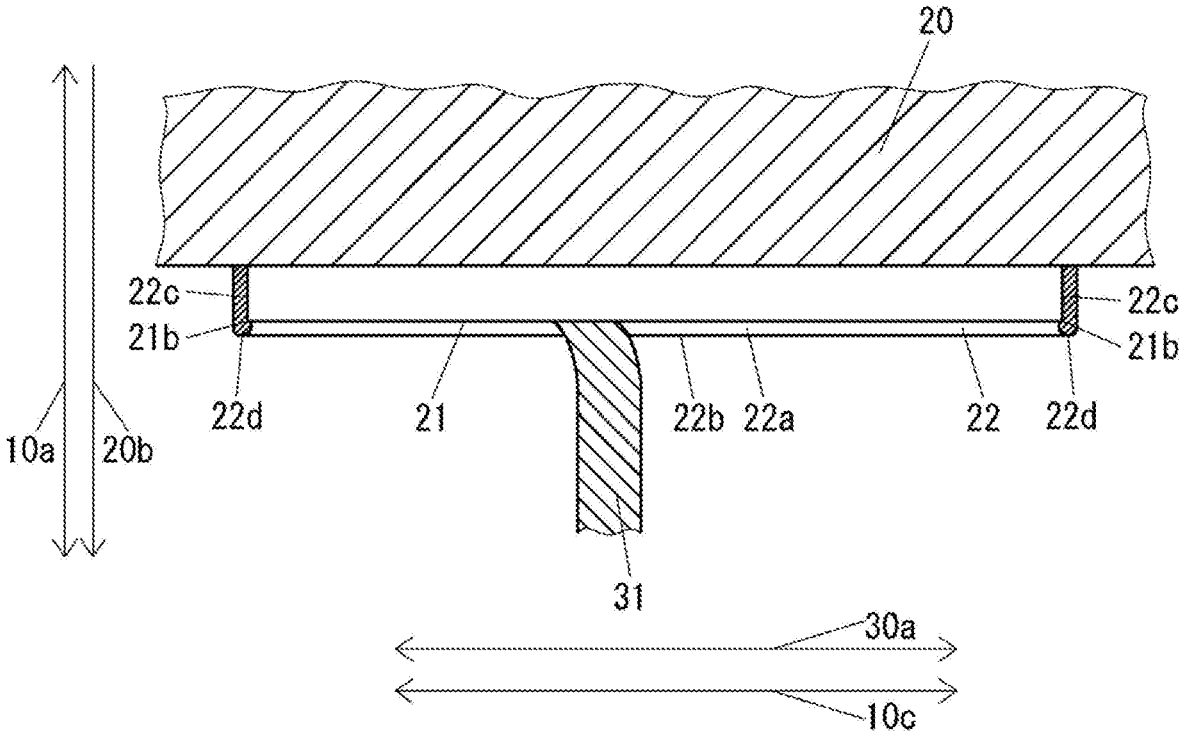
FIG. 5B is a side sectional view of the neighborhood part of the nozzle surface of the ink-jet head in a state shown in FIG. 5A.

FIG. 5A is a front sectional view of a neighborhood part of the nozzle surface 21 of the ink-jet head 20, in a state of the nozzle surface 21 being wiped by the wiping device 30, and FIG. 5B is a side sectional view of the neighborhood part of the nozzle surface 21 of the ink-jet head 20 in a state shown in FIG. 5A.

As shown in FIG. 5A and FIG. 5B; a direction represented with an arrow 30*a*, wherein the direction being a direction of wiping by the wiping device 30, is almost the same as a stretching direction of a line connecting the nozzles 21*a* being closest to the convex wall part 22, among the plurality of nozzles 21*a* (refer to FIG. 3) formed in the nozzle surface 21, and a part of the convex wall part 22 being closest to the above-mentioned nozzles 21*a*. In other words, the direction represented with the arrow 30*a* is almost the same as a stretching direction of the rows of the nozzles 21*a*, the stretching direction being represented with the arrow 10*c*. In the present context, the nozzles 21*a* being closest to the convex wall part 22, among the plurality of nozzles 21*a* formed in the nozzle surface 21, are the nozzles 21*a* having the distance 23*a* from the convex wall part 22 (refer to FIG. 3).

As shown in FIG. 5A; the convex wall part 22 includes two facing parts 22*a* that face each other in a direction represented with an arrow 30*b*, the direction being perpendicular to the direction represented with the arrow 30*a*. A length of the blade 31 in the direction represented with the arrow 30*b* is a length which makes it possible for the blade 31 to simultaneously contact tip parts 22*b*, protruding in the direction represented with the arrow 20*b*, of the two facing parts 22*a* of the convex wall part 22, at a time of wiping operation by the wiping device 30. Then, the wiping device 30 wipes out the nozzle surface 21 by use of the blade 31, while making the blade 31 simultaneously contact the tip parts 22*b* of the two facing parts 22*a*.

As shown in FIG. 5A; at the time of wiping out the nozzle surface 21 by use of the blade 31, the wiping device 30 keeps a position of the blade 31 in relation to the nozzle surface 21, in the direction represented with the arrow 10*a*, around a location that prevents the blade 31 from contacting a specific range 21*c* adjacent to the facing parts 22*a* in the nozzle surface 21. Therefore, at the time of wiping out the nozzle surface 21 by use of the blade 31, there is a chance that the ink 20*a* remains at an area of the range 21*c* in the nozzle surface 21. Incidentally, the nozzles 21*a* are not formed at the area of the range 21*c* in the nozzle surface 21.

Figure 6:
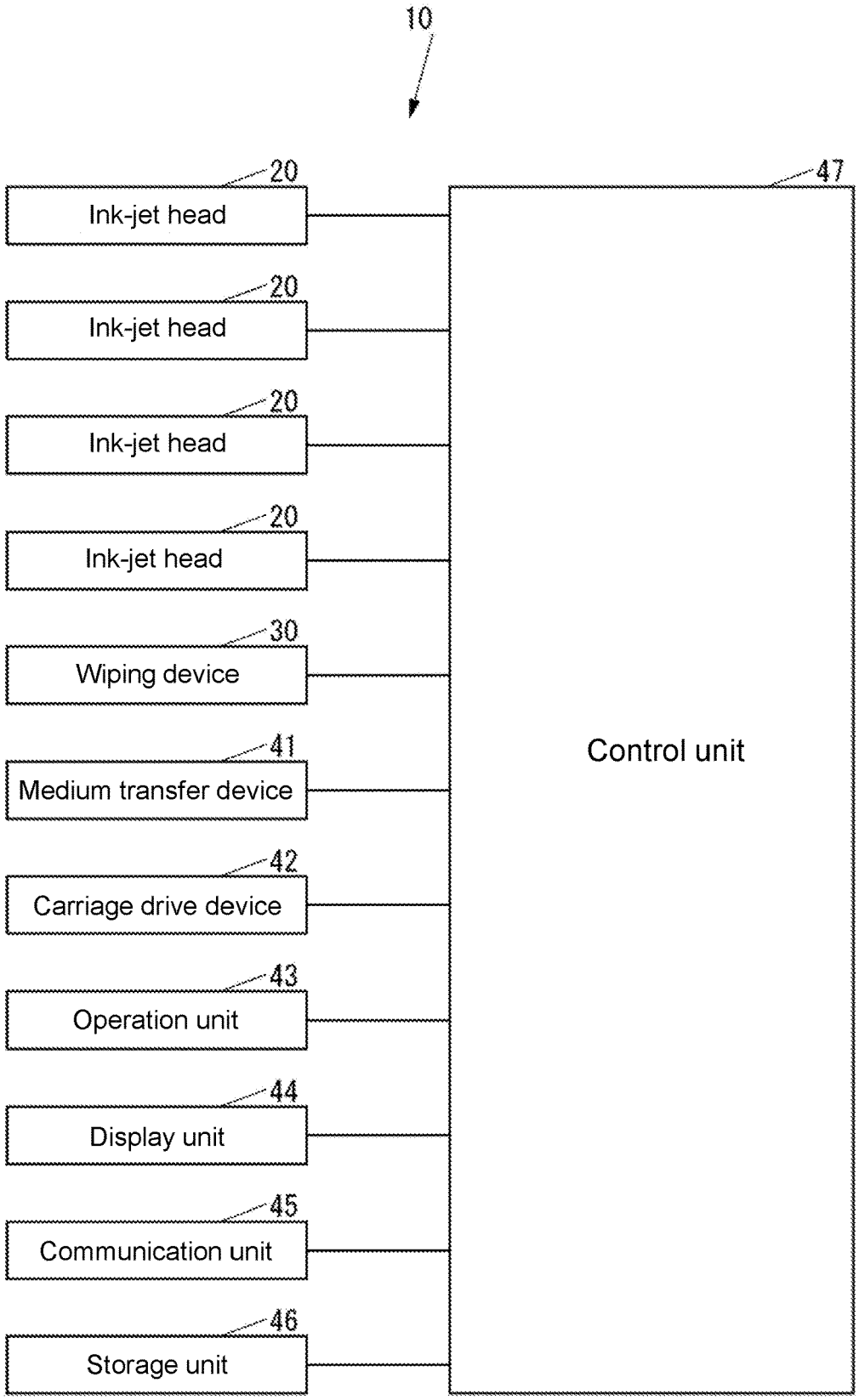
FIG. 6 is a block diagram of the ink-jet printer shown in FIG. 1.

FIG. 6 is a block diagram of the ink-jet printer 10.

As shown in FIG. 6, the ink-jet printer 10 includes; the ink-jet head 20; the wiping device 30; a medium transfer device 41 for transferring a medium 90 (refer to FIG. 1) in the direction represented with the arrow 10*c* (refer to FIG. 2A and FIG. 2B); a carriage drive device 42 for moving the carriage 13 (refer to FIG. 1) in the direction represented with the arrow 10*b* (refer to FIG. 1); an operation unit 43 that is an input device including, for example, a button with which various operations are entered; a display unit 44 that is a display device such as a liquid crystal display (LCD) for displaying various information; a communication unit 45 that is a communication device for establishing communication with an external unit, either through a network, or directly by way of wired or wireless communication without using a network; a storage unit 46 that is a non-volatile memory device, such as a semi-conductor memory, a hard disc drive (HDD), and the like for storing various kinds of information, and a control unit 47 for controlling an entire section of the ink-jet printer 10.

The control unit 47, for example, includes; a central processing unit (CPU); a read-only memory (ROM) for storing a program and various data; and a random access memory to be used as a workspace for the CPU. The CPU carries out the program stored in the ROM or the storage unit 46.

Operation of the ink-jet printer 10 is explained next.

Having received print data by way of the communication unit 45, the control unit 47 carries out printing operation for the medium 90, on the basis of the print data that is received by way of the communication unit 45. Namely, the control unit 47 carries out printing operation for the medium 90 in the direction represented with the arrow 10*b*, by way of transferring the carriage 13 in the direction represented with the arrow 10*b* by using the carriage drive device 42 and discharging the ink 20*a* toward the medium 90 by using the ink-jet head 20. Meanwhile, every time of carrying out printing operation for the medium 90 in the direction represented with the arrow 10*b*, the control unit 47 transfers the medium 90 in the direction represented with the arrow 10*c*, by using the medium transfer device 41, in such a way as to shift a printing position of the medium 90 in the direction represented with the arrow 10*c*.

In order to wipe the nozzle surface 21 by using the blade 31, the control unit 47 moves the carriage 13 in the direction represented with the arrow 10*b* by using the carriage drive device 42 at specific timing, so as to place the ink-jet head 20 to a position corresponding to the wiping device 30. Then, the control unit 47 wipes the nozzle surface 21 by using the blade 31, by way of moving the blade 31 by the wiping device 30 in the direction represented with the arrow 30*a*.

Figure 7A:
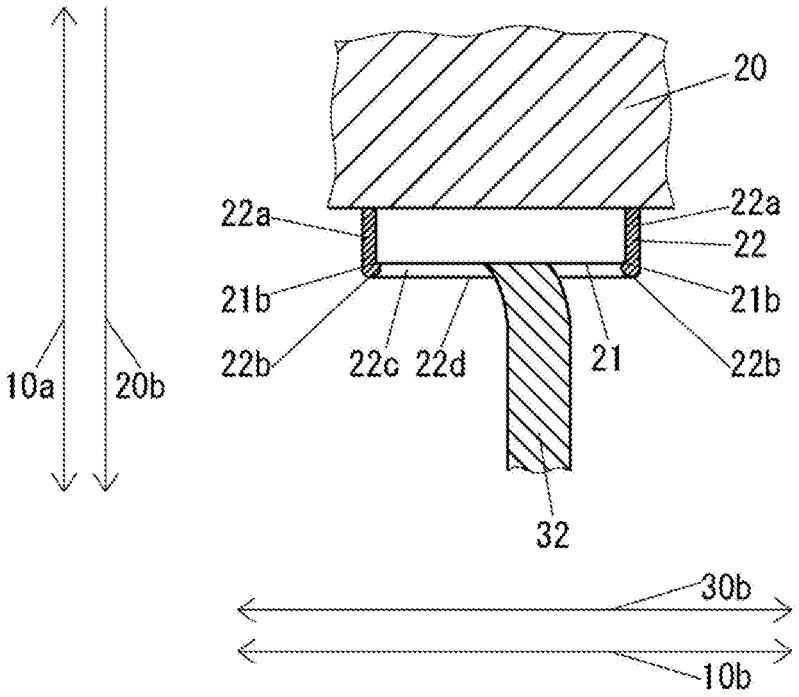
FIG. 7A is a front sectional view of a neighborhood part of the nozzle surface of the ink-jet head, in a state of the nozzle surface being wiped by a wiping device, in the case where a configuration of the wiping device is different from a configuration shown in FIG. 5A and FIG. 5B.
Figure 7B:
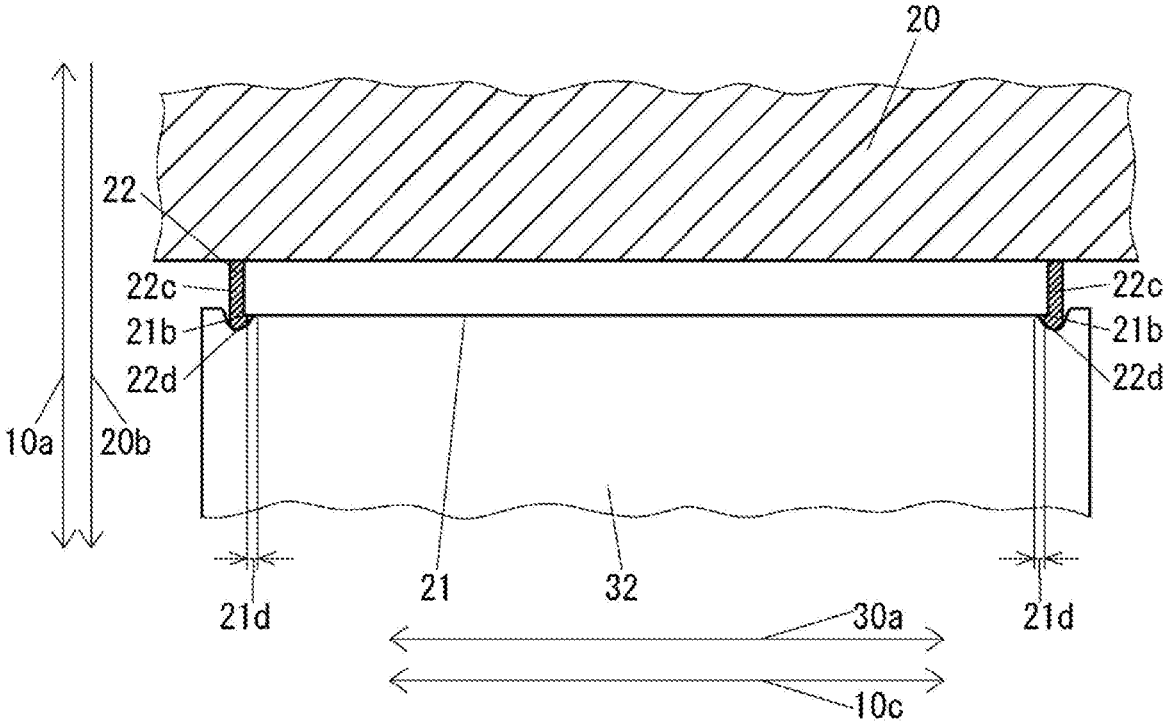
FIG. 7B is a side sectional view of the neighborhood part of the nozzle surface of the ink-jet head in a state shown in FIG. 7A.

Incidentally, before adopting the direction represented with the arrow 30*a* as a direction of wiping the nozzle surface 21 by the wiping device 30, a study was also conducted with respect to the direction represented with the arrow 30*b*, as shown in FIG. 7A and FIG. 7B.

FIG. 7A is a front sectional view of a neighborhood part of the nozzle surface 21 of the ink-jet head 20, in a state of the nozzle surface 21 being wiped by the wiping device 30, in the case where a configuration of the wiping device 30 is different from a configuration shown in FIG. 5A and FIG. 5B; meanwhile, FIG. 7B is a side sectional view of the neighborhood part of the nozzle surface 21 of the ink-jet head 20 in a state shown in FIG. 7A.

As shown in FIG. 7A and FIG. 7B, the wiping device 30 is provided with a blade 32, instead of the blade 31. The direction represented with the arrow 30*b*, shown in FIG. 7A and FIG. 7B; wherein the direction being a direction of wiping by the wiping device 30; is almost the same as a direction perpendicular to a stretching direction of a line connecting the nozzles 21*a* being closest to the convex wall part 22, among the plurality of nozzles 21*a* (refer to FIG. 3) formed in the nozzle surface 21, and a part of the convex wall part 22 being closest to the above-mentioned nozzles 21*a*. In other words, the direction represented with the arrow 30*b* is almost the same as the direction represented with the arrow 10*b*, which is perpendicular to a stretching direction of the rows of the nozzles 21*a*, the stretching direction being represented with the arrow 10*c*.

As shown in FIG. 7A; the convex wall part 22 includes two facing parts 22*c* that face each other in the direction represented with the arrow 30*a*. A length of the blade 32 in the direction represented with the arrow 30*a* is a length which makes it possible for the blade 32 to simultaneously contact tip parts 22*d*, protruding in the direction represented with the arrow 20*b*, of the two facing parts 22*c* of the convex wall part 22, at a time of wiping operation by the wiping device 30. Then, the wiping device 30 wipes out the nozzle surface 21 by use of the blade 32, while making the blade 32 simultaneously contact the tip parts 22*d* of the two facing parts 22*c*.

As shown in FIG. 7B; at the time of wiping out the nozzle surface 21 by use of the blade 32, the wiping device 30 keeps a position of the blade 32 in relation to the nozzle surface 21, in the direction represented with the arrow 10*a*, around a location that prevents the blade 32 from contacting a specific range 21*d* adjacent to the facing parts 22*c* in the nozzle surface 21. Therefore, at the time of wiping out the nozzle surface 21 by use of the blade 32, there is a chance that the ink 20*a* remains at an area of the range 21*d* in the nozzle surface 21.

Figure 8:
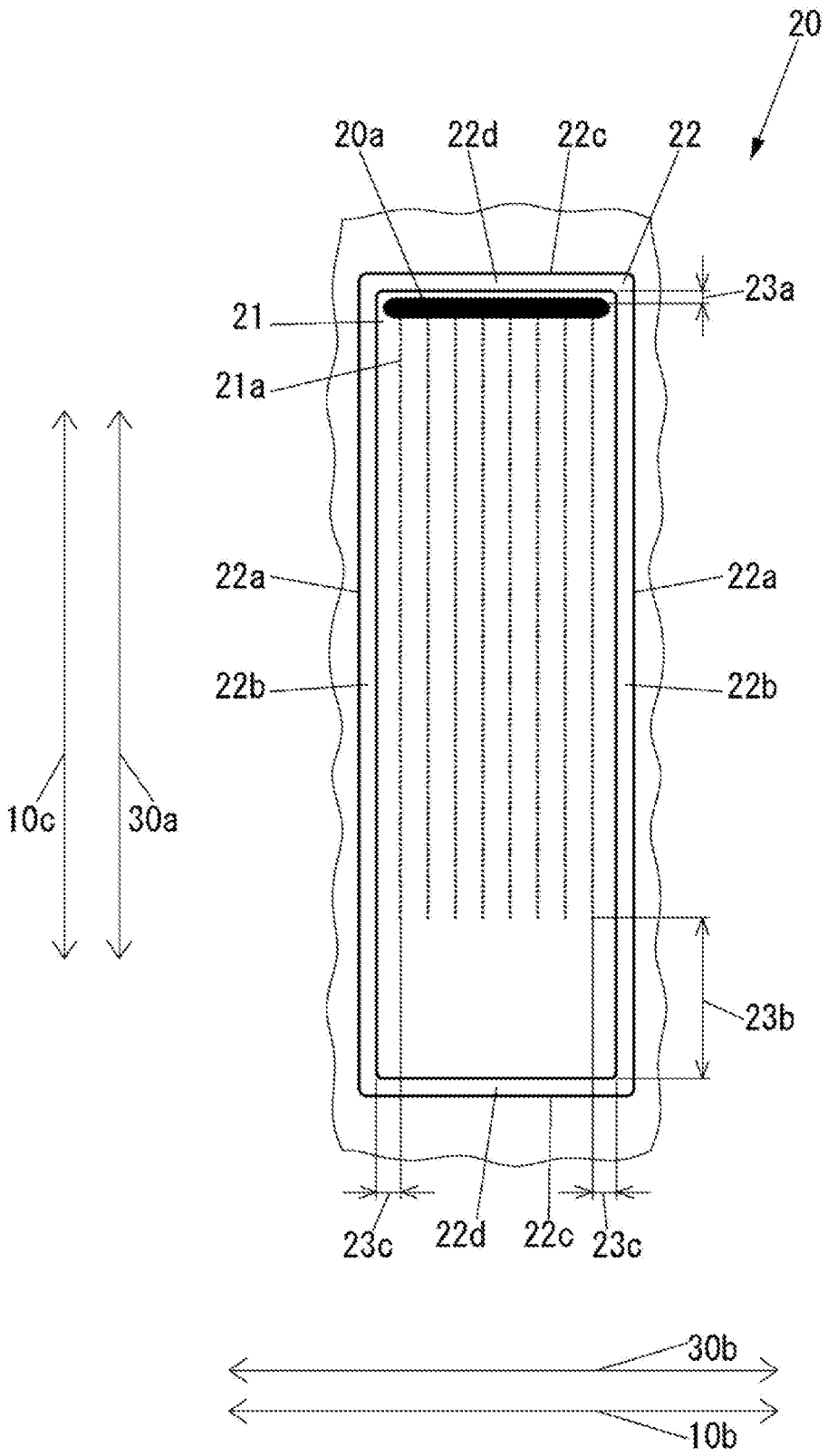
FIG. 8 is a bottom plan view of a part of the ink-jet head, just after being wiped by the wiping device, in the case where a configuration of the wiping device is as shown in FIG. 7A and FIG. 7B.

FIG. 8 is a bottom plan view of a part of the ink-jet head 20, just after being wiped by the wiping device 30, in the case where a configuration of the wiping device 30 is as shown in FIG. 7A and FIG. 7B.

In the case of the nozzle surface 21 wiped by the wiping device 30 in the direction represented with the arrow 30*b*, as shown in FIG. 7A and FIG. 7B, the ink 20*a* remained in the vicinity of the nozzles 21*a* having the distance 23*a* as a distance from the convex wall part 22, as shown in FIG. 8, on the nozzle surface 21 just after being wiped by the wiping device 30. With respect to a reason why the ink 20*a* remained in the vicinity of the nozzles 21*a* having the distance 23*a* as a distance from the convex wall part 22; it is considered that the ink 20*a* existing in the range 21*d* within the nozzle surface 21, which the blade 32 does not contact, was collected in the vicinity of the nozzles 21*a* having the distance 23*a* as the distance from the convex wall part 22, without being completely removed by the blade 32 because the distance 23*a* is too short, at a time of being removed by the blade 32 in a state of being repelled by way of the liquid-repellent property of the nozzle surface 21 so as to be collected. In the meantime, with respect to a reason why the ink 20*a* did not remain in the vicinity of the nozzles 21*a* having the distance 23*b* as a distance from the convex wall part 22; it is considered that the ink 20*a* existing in the range 21*d* within the nozzle surface 21, which the blade 32 does not contact, was completely removed by the blade 32, without staying in the vicinity of the nozzles 21*a* having the distance 23*b* as the distance from the convex wall part 22 because the distance 23*b* is long enough, at a time of being removed by the blade 32 in a state of being repelled by way of the liquid-repellent property of the nozzle surface 21 so as to be collected.

In the case of the nozzle surface 21 wiped by the wiping device 30 in the direction represented with the arrow 30*a*, as shown in FIG. 5A and FIG. 5B, the ink 20*a* did not remain, as shown in FIG. 3, on the nozzle surface 21 just after being wiped by the wiping device 30. With respect to a reason why the ink 20*a* did not remain in the vicinity of the nozzles 21*a* having the distance 23*c* as the distance from the convex wall part 22; it is considered that the ink 20*a* existing in the range 21*c* within the nozzle surface 21, which the blade 31 does not contact, was completely removed by the blade 31, without staying in the vicinity of the nozzles 21*a* having the distance 23*c* as the distance from the convex wall part 22 because the distance 23*c* is long enough, at a time of being removed by the blade 31 in a state of being repelled by way of the liquid-repellent property of the nozzle surface 21 so as to be collected.

As a result of the study, it was found that, i.e., "the ink 20*a* is liable to remain and the amount of the remaining ink is much more after wiping the nozzle surface 21 by a blade, at a vicinity of an end of the convex wall part 22 within the nozzle surface 21 in a direction perpendicular to a wiping direction, in comparison to a vicinity of an end of the convex wall part 22 within the nozzle surface 21 in the wiping direction."

Incidentally, a risk of an incidence of defective discharging of the ink 20*a* by the ink-jet head 20 is heightened, owing to presence of the ink 20*a*, remaining on the nozzle surface 21 after wiping, in the vicinity of the nozzles 21*a*. It is because the ink 20*a* remaining in the vicinity of the nozzles 21*a* moves onto the nozzles 21*a* so as to become a cause of defect, such as plugging the nozzles 21*a*, and the like. Therefore, it is preferable that the nozzles 21*a* are not located in the vicinity of an area where the ink 20*a* is liable to remain after wiping the nozzle surface 21 by use of the blade.

In the case of the ink-jet printer 10, wiping operation is carried out in the direction being almost the same as the stretching direction of the line connecting the specific nozzles 21*a* being closest to the convex wall part 22, among the plurality of nozzles 21*a* formed in the nozzle surface 21, and a part of the convex wall part 22 being closest to the above-mentioned nozzles 21*a*; that is to say, in the direction represented with the arrow 30*a*; in such a way that, being compared to a case of configuration in which wiping operation is carried out in a direction perpendicular to the above-described direction, i.e., in the direction represented with the arrow 30*b*, the ink 20*a* is unlikely to remain in the vicinity of the end of the convex wall part 22 so that the remaining amount of the ink 20*a* is less.

Accordingly, the ink-jet printer 10 is able to suppress presence of the ink 20*a* remaining on the nozzle surface 21 after wiping operation, in the vicinity of the nozzles 21*a*; and as a result, an incidence of defective discharging of the ink 20*a* by the ink-jet head 20 can be reduced.

In the case where the nozzle surface 21 having a liquid-repellent property is wiped by a blade, the ink 20*a* existing on the nozzle surface 21 is removed by the blade in a state of being repelled by way of the liquid-repellent property of the nozzle surface 21 so as to be collected. In the meantime, a hole of the nozzles 21*a* of the nozzle surface 21 is inevitably filled with the ink 20*a*, while the hole does not have a liquid-repellent property, so that the ink 20*a* is liable to remain after wiping operation by a blade, around the hole of the nozzles 21*a* and its vicinity, in comparison to any area other than the vicinity of the hole of the nozzles 21*a*.

In the case where a distance from the hole of the nozzles 21*a* to the convex wall part 22 is short; if the amount of the ink 20*a* remaining in the vicinity of the end of the convex wall part 22 is substantially large after wiping the nozzle surface 21 by use of the blade, a risk of the ink 20*a* to become a cause of defect, by way of moving onto the nozzles 21*a* and plugging the nozzles 21*a*, and the like, is heightened; wherein the ink 20*a* remains in the vicinity of the end of the convex wall part 22.

According to the present embodiment, the nozzle surface 21 is wiped by the blade 31 in the direction being almost the same as the stretching direction of the line connecting the nozzles 21*a* being closest to the convex wall part 22, among the plurality of nozzles 21*a* formed in the nozzle surface 21, and a part of the convex wall part 22 being closest to the above-mentioned nozzles 21*a*; that is to say, in the direction represented with the arrow 30*a*; in such a way that, being compared to the case where the nozzle surface 21 is wiped by the blade 32 in the direction represented with the arrow 30*b*, perpendicular to the direction represented with the arrow 30*a*, the ink 20*a* is unlikely to remain in the vicinity of the nozzles 21*a* in the neighborhood of the convex wall part 22 in the nozzle surface 21, and therefore, the amount of the ink remaining can be made less.

Accordingly, even in the case where the distance from the nozzles 21*a* to the convex wall part 22 is short, and the nozzle surface 21 has a liquid-repellent property, the amount of the ink remaining can be made less in the vicinity of the end of the convex wall part 22 after wiping the nozzle surface 21 by use of the blade 31, so that it is possible to suppress a defective incidence, such as the ink 20*a* moving onto the nozzles 21*a* and plugging the nozzles 21*a*, and the like; wherein the ink 20*a* remains in the vicinity of the end of the convex wall part 22.

After an end of the blade 31, being in a direction perpendicular to the wiping direction represented with the arrow 30*a*, slides on the nozzle surface 21, sometimes the ink 20*a* remains in a form according to a trajectory of the end of the blade 31, at a position of the nozzle surface 21 where the blade 31 does not slide. Fortunately, in the case of the ink-jet printer 10; at the time when the nozzle surface 21 is wiped by the blade 31, the blade 31 simultaneously contacts the tip parts 22*b* of the two facing parts 22*a* of the convex wall part 22; and therefore, the end of the blade 31, being in the direction perpendicular to the wiping direction represented with the arrow 30*a*, does not slide on the nozzle surface 21. Accordingly, the ink-jet printer 10 can reduce the amount of the ink 20*a* remaining on the nozzle surface 21 having been wiped; and as a result, an incidence of defective discharging of the ink 20*a* by the ink-jet head 20 can be reduced.

At the time of wiping the nozzle surface 21 by use of the blade 31, the ink-jet printer 10 does not have the blade 31 contact an area of the range 21*c* in the vicinity of the facing parts 22*a* in the nozzle surface 21; and therefore, being compared to a case of configuration in which the blade 31 contacts the area of the range 21*c* in the vicinity of the facing parts 22*a* in the nozzle surface 21 at the time of wiping the nozzle surface 21 by use of the blade 31, a blade 31 having low flexibility can be employed; and as a result, durability of the blade 31 can be improved.

In an area of the nozzle surface 21 where the nozzles 21*a* are formed, the ink 20*a* is liable to remain just after wiping the nozzle surface 21 by the blade 31. Fortunately, in the case of the ink-jet printer 10; the nozzles 21*a* are not formed in the area of the range 21*c*, which the blade 31 does not contact at the time of wiping, in the nozzle surface 21; and therefore, the amount of the ink 20*a* remaining in the vicinity of the nozzles 21*a* in the neighborhood of the convex wall part 22, in the nozzle surface 21 having been wiped, can be reduced; and as a result, an incidence of defective discharging of the ink 20*a* by the ink-jet head 20 can be reduced.

Incidentally, in the ink-jet head 20; according to the present embodiment, the stretching direction of the line connecting the specific nozzles 21*a* being closest to the convex wall part 22, among the plurality of nozzles 21*a* formed in the nozzle surface 21, and a part of the convex wall part 22 being closest to the above-mentioned nozzles 21*a* is almost the same as the stretching direction, being represented with the arrow 10*c*, of the rows of the nozzles 21*a*. Meanwhile, in the ink-jet head 20; the stretching direction of the line connecting the specific nozzles 21*a* being closest to the convex wall part 22, among the plurality of nozzles 21*a* formed in the nozzle surface 21, and a part of the convex wall part 22 being closest to the above-mentioned nozzles 21*a* may be almost the same as the direction represented with the arrow 10*b* that is perpendicular to the stretching direction, being represented with the arrow 10*c*, of the rows of the nozzles 21*a*.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An ink-jet printer comprising:

an ink-jet head having a nozzle surface provided with a nozzle row formed by arranging a plurality of nozzles for discharging ink; and a wiping device, provided with a blade for wiping the nozzle surface, which carries out wiping the nozzle surface by use of the blade, by way of moving the blade in relation to the nozzle surface;

wherein, the ink-jet head is provided with a convex wall part that surrounds the nozzle surface in a state of protruding in a direction in which the ink is discharged by the nozzles; and a direction of wiping by the wiping device is substantially the same as an extending direction of the nozzle row, wherein, the blade is flexible and in a straight line shape, in which a front edge facing the nozzle is substantially parallel to the nozzle surface, the blade has a length in a direction perpendicular to the direction of wiping which allows the blade to simultaneously contact tip parts of two facing parts of the convex wall part protruding in the direction in which the ink is discharged when wiping by the wiping device, the two facing parts are facing each other in the direction perpendicular to the direction of wiping; and the wiping device wipes the nozzle surface with the blade while simultaneously contacting the blades with the tip parts of the two facing parts and contacting the blades with the nozzle surface.

2. The ink-jet printer according to claim 1, wherein, the nozzle surface has a liquid-repellent property.

3. The ink-jet printer according to claim 1, wherein, the blade is kept from contacting a specific area adjacent to the facing parts in the nozzle surface, at a time of wiping the nozzle surface by use of the blade.

4. The ink-jet printer according to claim 3, wherein, the nozzles are not formed in the specific area.

5. An ink-jet printer comprising:

an ink-jet head having a nozzle surface provided with a nozzle row formed by arranging a plurality of nozzles for discharging ink; and a wiping device, provided with a blade for wiping the nozzle surface, which carries out wiping the nozzle surface by use of the blade, by way of moving the blade in relation to the nozzle surface;

wherein, the ink-jet head is provided with a convex wall part that surrounds the entire nozzle surface in a state of protruding in a direction in which the ink is discharged by the nozzles; and a direction of wiping by the wiping device is substantially perpendicular to an extending direction of the nozzle row, wherein, the blade is flexible and in a straight line shape, in which a front edge facing the nozzle is substantially parallel to the nozzle surface, the blade has a length in a direction perpendicular to the direction of wiping which allows the blade to simultaneously contact tip parts of two facing parts of the convex wall part in the direction in which the ink is discharged when wiping by the wiping device, the facing parts facing each other in the direction perpendicular to the direction of wiping; and the wiping device wipes the nozzle surface with the blade while simultaneously contacting the blades with the tip parts of the two facing parts and contacting the blades with the nozzle surface.

* * * * *